US012117179B2

(12) United States Patent
Zemel et al.

(10) Patent No.: US 12,117,179 B2
(45) Date of Patent: Oct. 15, 2024

(54) FIRE PIT-STORABLE PANEL SYSTEMS AND METHODS

(71) Applicant: Mr. Bar-B-Q Products LLC, Hauppauge, NY (US)

(72) Inventors: Marc Zemel, Hauppauge, NY (US); Joanne Rudis, Hauppauge, NY (US)

(73) Assignee: MR. BAR-B-Q PRODUCTS LLC, Hauppauge, NY (US)

( * ) Notice: Subject to any disclaimer, the term of this patent is extended or adjusted under 35 U.S.C. 154(b) by 262 days.

(21) Appl. No.: 17/683,440

(22) Filed: Mar. 1, 2022

(65) Prior Publication Data

US 2022/0252274 A1 Aug. 11, 2022

Related U.S. Application Data

(63) Continuation of application No. 16/712,258, filed on Dec. 12, 2019, now Pat. No. 11,293,645.

(60) Provisional application No. 62/781,313, filed on Dec. 18, 2018.

(51) Int. Cl.

| | |
|---|---|
| ***F24C 15/12*** | (2006.01) |
| ***A47B 37/04*** | (2006.01) |
| ***F24B 1/192*** | (2006.01) |
| ***F24C 3/02*** | (2021.01) |
| *F24B 1/181* | (2006.01) |

(52) U.S. Cl.

CPC ..... *F24C 15/12* (2013.01); *A47B 37/04* (2013.01); *F24B 1/192* (2013.01); *F24C 3/02* (2013.01); *F24B 1/181* (2013.01)

(58) Field of Classification Search

CPC ..... F24B 1/192; F24B 1/181; A47B 37/04; A47B 13/081; F24C 3/02; F24C 15/12

See application file for complete search history.

(56) References Cited

U.S. PATENT DOCUMENTS

| | | | | |
|---|---|---|---|---|
| 651,638 | A | 6/1900 | Norris | |
| 2,084,779 | A | 6/1937 | Rosser | |
| 2,608,305 | A | 8/1952 | Sager | |
| 3,221,137 | A | 11/1965 | Madden | |
| 3,244,163 | A | 4/1966 | McGlaughlin | |
| 3,675,171 | A | 7/1972 | Kirk | |
| 4,616,626 | A | 10/1986 | Kwan Soon | |
| 4,840,279 | A | 6/1989 | Cobb et al. | |
| 4,850,556 | A * | 7/1989 | Otani | A47J 47/16 248/302 |

(Continued)

OTHER PUBLICATIONS

Office Action issued by the Canadian Intellectual Property Office on Sep. 29, 2023 in corresponding CA Patent Application No. 3,065,476, pp. 1-4.

*Primary Examiner* — Alfred Basichas

(74) *Attorney, Agent, or Firm* — Carter, DeLuca & Farrell LLP

(57) ABSTRACT

A multi-use convertible furniture piece, having a table top including a channel, the channel configured to receive a lid panel therethrough, a support frame connected to the table top, a door operably connected to the frame, the door including at least one receiving pocket, the lid panel configured to connect to the table top and the door, and wherein the door is hinged to the support frame and a portion of the lid panel is received into the receiving pocket. The multi-use convertible furniture piece is also configured to receive and store the lid panel on at least one portion of the support frame.

21 Claims, 13 Drawing Sheets

(56) References Cited

U.S. PATENT DOCUMENTS

| | | | |
|---|---|---|---|
| 6,065,466 | A | 5/2000 | Baykal |
| 8,475,811 | B2 | 7/2013 | Yang et al. |
| 9,420,879 | B1 | 8/2016 | Brandenberg |
| 10,188,240 | B2 | 1/2019 | Clarke |
| 2005/0109331 | A1 | 5/2005 | Chao |
| 2006/0054160 | A1 | 3/2006 | Borowske et al. |
| 2012/0222668 | A1 | 9/2012 | Unger |
| 2013/0255659 | A1 | 10/2013 | Fulp et al. |
| 2015/0250305 | A1 | 9/2015 | Kahler et al. |
| 2016/0029852 | A1 | 2/2016 | Ljung |
| 2016/0166109 | A1 | 6/2016 | Banal et al. |
| 2017/0030584 | A1 | 2/2017 | Mueller et al. |
| 2017/0127820 | A1 | 5/2017 | Bortolato et al. |
| 2017/0276372 | A1 | 9/2017 | Quigley |
| 2018/0055218 | A1 | 3/2018 | Mueller |
| 2019/0162411 | A1 | 5/2019 | Choi et al. |
| 2021/0100361 | A1 | 4/2021 | Nathan et al. |

* cited by examiner

FIRE PIT-STORABLE PANEL SYSTEMS AND METHODS

CROSS-REFERENCE TO RELATED APPLICATIONS

The present application is a continuation of U.S. patent application Ser. No. 16/712,258, filed on Dec. 12, 2019, which claims the benefit of and priority to U.S. Provisional Patent Application Ser. No. 62/781,313, filed on Dec. 18, 2018, the entire contents of which are incorporated by reference herein.

FIELD OF THE TECHNOLOGY

The present device and methods relate to the field of outdoor grills and/or fire pits, and in particular to, multi-function convertible outdoor grills and/or fire pits which can be used as a piece of furniture or as a table.

BACKGROUND

Fire pits prolong the enjoyment of backyard landscaping; provide a convenient means for preparing foods; and provide the function to double as tables.

Multi-function convertible fire pits (multi-use convertible device or convertible fire pits) that can double as tables have become a must-have household appliance. These multi-function convertible fire pits generally consist of a fire bowl, a lid, or lid panel built to cover the fire bowl. The panel converts the fire pit into a table on which objects may be placed, and can be used for purposes such as eating, writing, working, or gaming.

Fire safety is extremely important and lid panel placement is one overlooked fire safety danger when dealing with convertible fire pits. The lid panel is typically configured to cover the fire bowl, and while the fire bowl is being used the panel is usually left unattended. An unattended lid panel can be a major safety hazard in any household, especially in a household with children.

Commonly, most convertible fire pits are not configured to store the lid panel in a safe and convenient way. Thus, there is a continuing interest in developing safe convertible fire pits that allow a user to store the lid panel in a safe and convenient manner.

SUMMARY

Existing challenges associated with the foregoing, as well as other challenges, are overcome by methods associated with converting a fire pit into a table or piece of furniture, or vice-versa, and to help users to safely and conveniently store lid panels, and also by systems, and apparatuses that operate in accordance with the methods. Moreover, the present disclosure relates to a multi-function convertible furniture piece that contains a fire pit and a storable lid panel.

According to aspects of the present disclosure, the multi-use convertible furniture and other features of the invention disclosed herein overcome the foregoing and other shortcomings of conventional designs.

In various embodiments, the convertible fire pit device may include a door panel. In other embodiments, the door panel may be received by a pocket or a channel.

In various embodiments, the convertible fire pit device may include a table top with a channel, the channel may be configured to receive a lid panel; a support frame is configured to the table top; a door is configured to the frame; the door may include at least one receiving pocket; the lid panel is configured to the table, the top, and the door; and where the door is hinged to the support frame—a portion of the lid panel is received into the receiving pocket.

In other embodiments, the convertible fire pit device further includes a fire bowl configured to the tabletop and configured to pass through the channel of the table top.

In selected embodiments, the multi-use convertible device further includes a burner.

In aspects, the multi-use convertible device further includes a fuel distribution system configured to the burner.

In other aspects, the multi-use convertible device further includes a heater configured to the fuel distribution system.

According to aspects of the present disclosure, a method for storage of a lid panel, the method includes receiving a lid panel above a fire bowl and through an opening of a fire pit device; removing the lid panel from the opening; and connecting the lid panel to a door connected to the fire pit device.

In various embodiments, the method may include means to locally store the lid panel within the fire pit device.

According to further aspects of the present disclosure, a multi-use convertible device includes a table with a first and second opening, the openings defining a first and second channel and configured to receive a movable lid panel; the movable lid panel configured to the table; where the second channel is encompassed by the first opening; and where the first opening is configured to receive the door at a horizontally and vertically position, and the second opening is configured to receive the door at a substantially horizontal position.

Further details and aspects of exemplary embodiments of the present disclosure are described in more detail below with reference to the appended figures.

BRIEF DESCRIPTION OF THE DRAWINGS

The accompanying drawings, which are incorporated in and constitute part of this specification, illustrate embodiments of the present disclosure and, together with a general description of the present disclosure given above, and the detailed description of the embodiments given below, serve to explain the principles of the present disclosure.

DETAILED DESCRIPTION

Detailed embodiments of the present system and method are disclosed herein. It is to be understood, however, that the disclosed embodiments are merely exemplary of the apparatus and methods as a whole, which may be embodied in various and alternative forms. The figures are not necessarily to scale, and some figures may be configured to show the details of a particular component. Therefore, specific structural and functional details disclosed herein are not to be interpreted as limiting, but merely as a representative basis for the claims and for teaching one skilled in the art to practice the present invention.

Various embodiments of the presently disclosed fire pit device and methods of using the same will be described in detail with reference to the drawings wherein like reference's numerals identify similar or identical elements.

The present disclosure relates to a fire pit device including a panel which can be stored securely and conveniently within a fire pit device. For example, the panel may be stored within the fire pit device and the fire pit device may include means to safely receive the panel, where the lid panel may be configured as a slidable, detachable, and collapsible or the like lid panel. As used herein, the term "lid panel" refers to and includes a lid, cover, cap, closure, top, shield, or the like.

Figure 1:
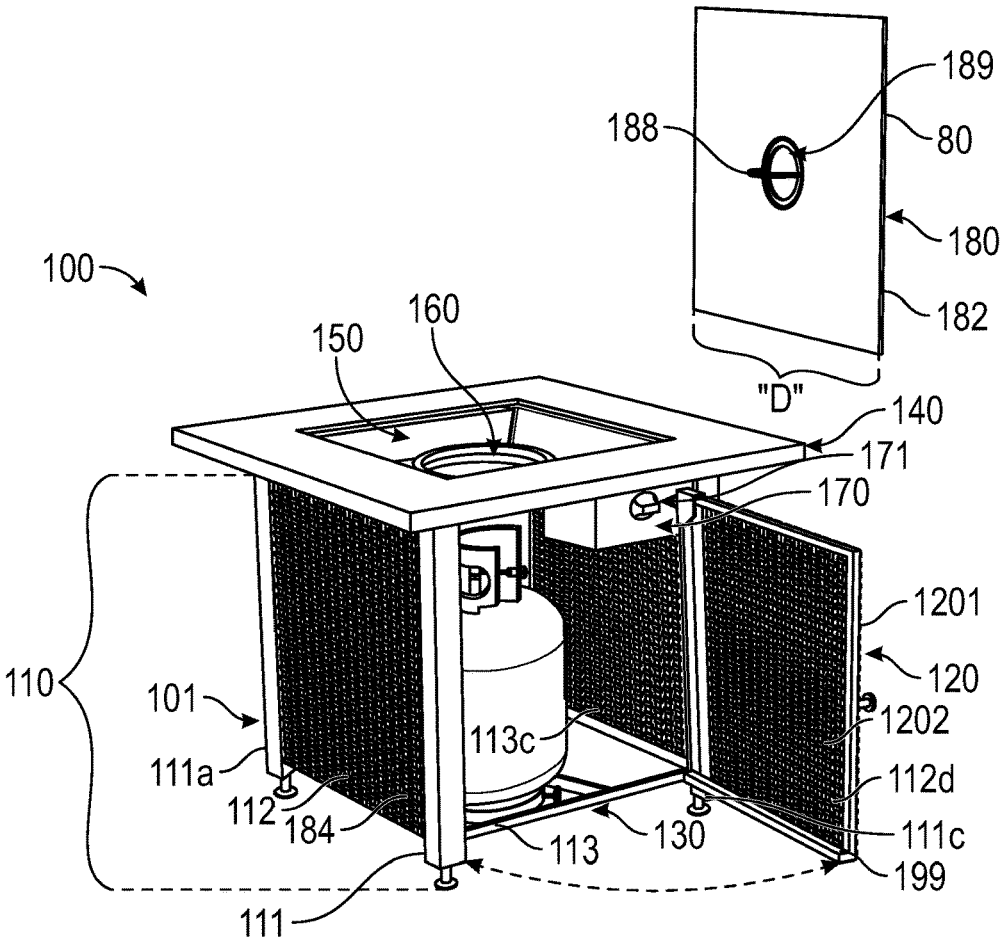
FIG. 1 depicts a perspective view of an exemplary embodiment of a fire pit device prior to storing of a lid associated thereof, in accordance with the present disclosure.
Figure 3:
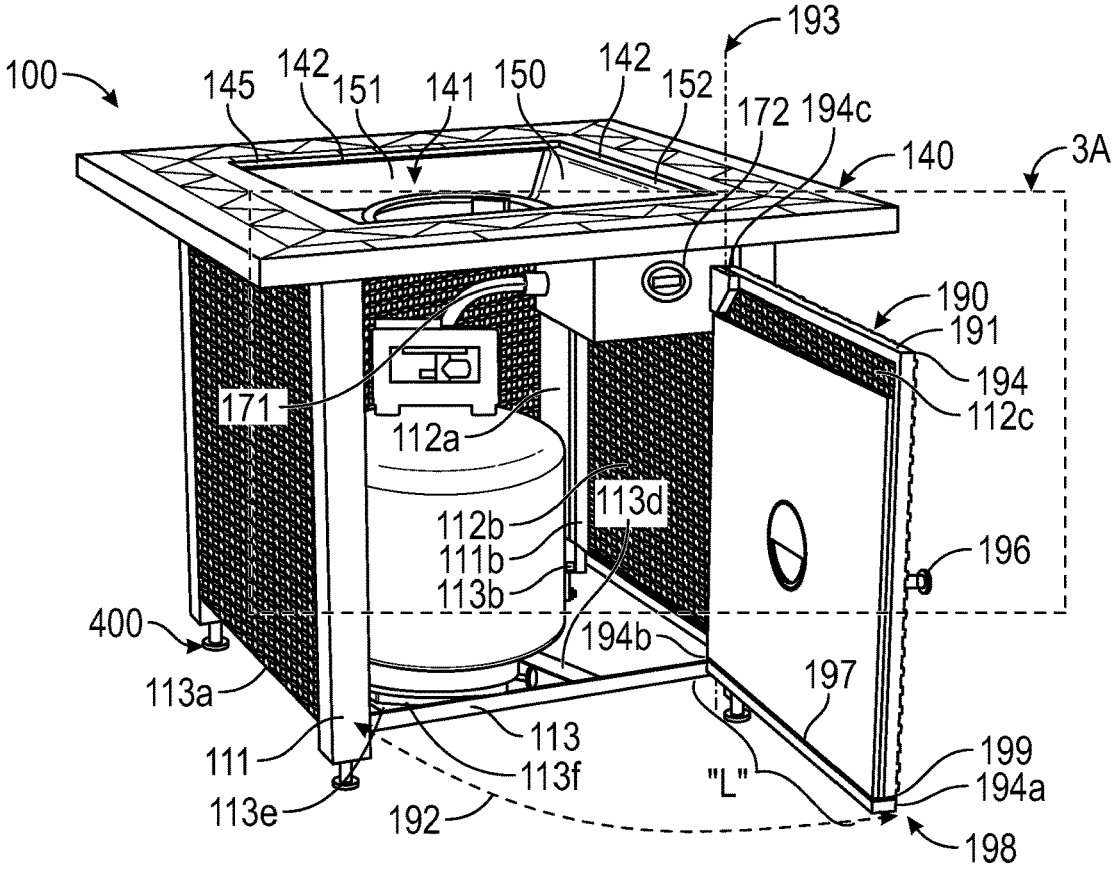
FIG. 3 depicts a perfective views of the fire pit device of FIG. 1, in accordance with the present disclosure
Figure 3A:
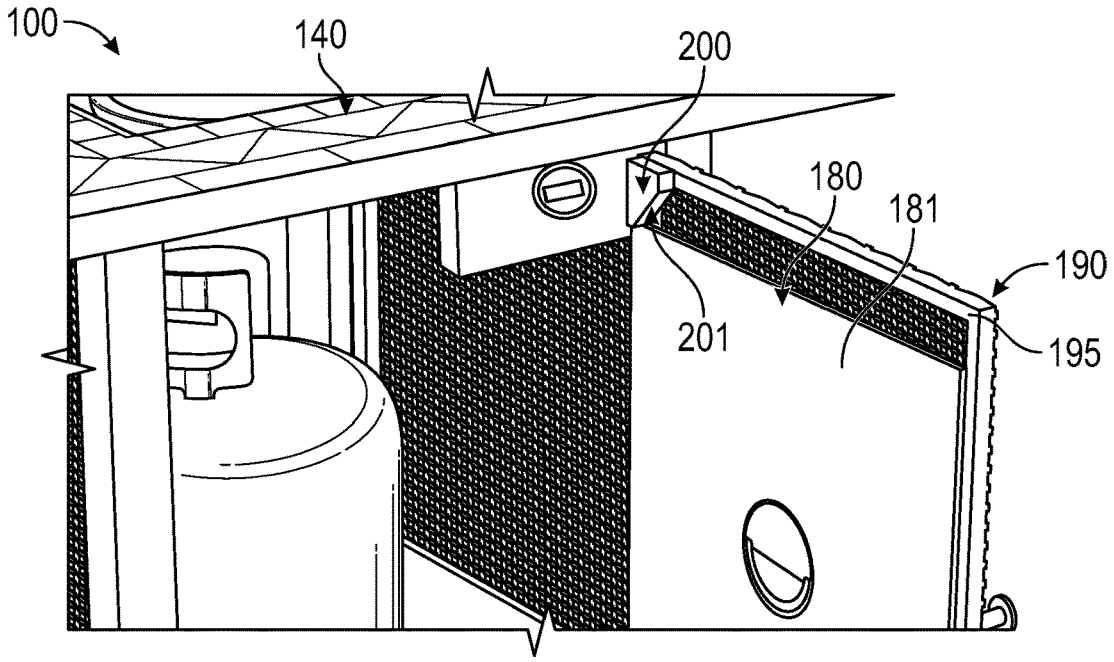
FIG. 3A depicts an enlarged view of the fire pit device of FIG. 3 in accordance with the section 3A in FIG. 3.

Referring to FIGS. 1 and 3A, an embodiment of the fire pit device 100 in accordance with the present disclosure is shown. The fire pit device 100 includes a support frame 110, a door panel 120 (including a door frame 1201 and a panel 1202), a vessel support structure 130, a table top 140, a fire bowl 150, a burner 160, and a lid panel 180. In embodiments the fire pit device 100 may include a board or a plurality of boards (such as board 184) connected to the support frame 110; board 184 may be configured similarly to panel 1202. In the illustrated embodiment, fire pit device 100 is shown having a substantially rectangular shape, with the support frame 110 configured to resemble the shape of a square box. It is understood that the support frame 110 can be configured to have any other appearance or shape, such as a cylindrical shape, trapezoidal shape, or a naked frame, such as a rectangular frame, triangle frame, or the like. In other words, the support frame 110 can be configured as a symmetrical or asymmetrical three-dimensional structure with either a solid or hollow body. The support frame 110 may be constructed out of a plurality of conduits or beams made of known in the art materials such as aluminum, wood, steel, iron, resin, tile, glass, slate, stone, granite, ceramic, concrete or the like; and manufactured accordingly to well known in the art techniques such as welding, stamping, molding, cutting, additive manufacture, or with adhesives, and the like. The door panel 120 is movable and generally hinged to the support frame 110. The support frame 110 and the door panel 120 may be configurable to receive or connect to the lid panel 180.

In selected embodiments, the fire pit device 100 may be constructed to include a plurality of beams connected via welding, fasteners (such as glue, screws, etc.) or the like which may form the support frame 110 which may be ultimately fastened to the table top 140. Alternatively, the fire pit device 100 may be configured substantially similarly to a table. Moreover, the fire pit device 100 may be configured in such way that the table top 140 may be a flat top connected to one or more legs, providing a leveled surface on which objects may be placed. Moreover, in embodiments, the one or more legs may be interconnected via crossed or horizontal beams.

Figure 2:
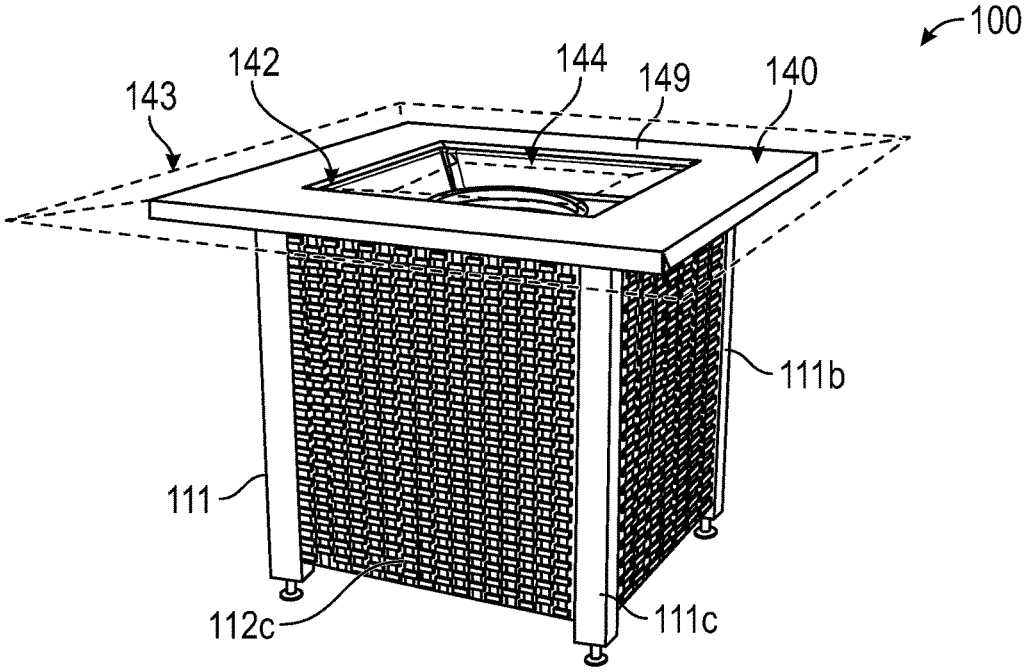
FIG. 2 depicts a perfective view of the fire pit device of FIG. 1, in accordance with the present disclosure.

As shown in FIGS. 1-3, the table top 140 may be connected to legs 111, 111*a*, 111*b*, and 111*c*. Additionally, a plurality of side panels or at least one panel such as panels 112, 112*a*, and 112*b*, may be each fastened to at least one pair of legs selected from legs 111-111*c* via screws, weld, glue or other suitable fastening elements and completed by commonly used in the art coupling methods such as welding, fasteners (such as screws, pins, or the like), or bonding (via laser, glue, or the like). Further, support frame 110 may include a plurality of beams or at least two beams. As depicted in the exemplary embodiment in FIG. 3, beams 113, 113*a*, 113*b*, and 113*c* are each respectively connected to a pair of legs selected from legs 111-111*c* found in FIG. 1-2. Moreover, beam 113 is connected to legs 111, and 111*c*; beam 113*a* (not shown) is connected to legs 111, and 111*a*; beam 113*b* (not shown) is connected to legs 111*a*, and 111*b*; beam 113*c* is connected to legs 111*b*, and 111*c*. The plurality of beams may be disposed at a bottom portion 101 of the fire pit device 100 in a horizontal position and substantially perpendicular to the plurality of legs, thus it is implied that the legs 111-111*c* may be disposed substantially parallel to one another. It is worth mentioning that in selected embodiments it may be desired to have fire pit device 100 configured to include less than four beams (e.g. just one or two beams selected from beams 113 and 113*c*).

Further, it may be desired to include additional beams at the bottom portion 101 of the fire pit device 100 such as beams 113*d*, 113*e*, and a circular beam 113*f*. The just mentioned three beams when coupled to at least one of the above-mentioned beams 113-113*c* may define the vessel support structure 130. In general, the vessel support structure 130 may be configured to receive and secure a vessel such as a propane tank. Thus, it is understood that in these embodiments the vessel support structure 130 may be different to the just mentioned configuration, for example, the vessel support structure 130 may include a hook where a vessel can be suspended from, or in selected embodiment a vessel support structure 130 may not be included in a fire pit device. In embodiments, the fire pit device 100 may include a control box or fluid distribution system 170 which may include at least one fluid inlet 171 a valve (not shown) connected to a knob 172, where fluid distribution system 170 is ultimately connected to the burner 160. The burner 160 may be coupled to the fire bowl 150, and the fire bowl 150 may be coupled to the table top 140. The couplings may be made via fastening such as screws, retaining tabs, welding materials, bonding materials, or the like. In addition, in selected embodiments the fire bowl may be configured as a circular, square, rectangle or triangle fire bowl.

In embodiments, the table top 140 may include an opening 141 (FIG. 3) which defines a tabletop channel 142; which may be configured to receive the fire bowl 150 and the lid panel 180 (FIG. 1). In general, the lid panel 180 and alternative embodiments thereof, which will be described more in the detail further, may be store anywhere adjacent to support frame 110 and may be further enclosed by the panels connected to support frame 110 and the door panel 120. The fire bowl 150 may be removably connected, and further in embodiments fastened by any known fastening means, to the table top 140 or the support frame 110. In embodiments, the table top 140 may further include a tabletop lip (not shown) disposed adjacent to the opening 141 and configured as a peripheral lip (not shown) which is ultimately connected to an interior surface 145 defined by the channel 142. The table top lip (not shown) may be configured to connect to the fire bowl's upper portion 151. For example the fire bowl's upper portion 151 may further include a fire bowl lip 152 configured to rest onto the table top lip (not shown). Alternatively, in embodiments, it may be desired to have the fire bowl lip 152 and/or the table top lip (not shown) configured as mating tabs which may connect to each other.

Further, the table top 140 may define a first plane 143 parallel to a table top surface 149, and when the fire pit device 100 is in its upright position (as shown in the illustrations in FIGS. 1-3), the first plane 143 may be parallel with the ground. When assembling the fire pit device 100, either one of the above-mentioned configurations of the fire bowl lip 152 and the table top lip (not shown) may enable a user to connect the fire bowl 150 to table top 140. Post assembly, the channel 142 may define a second plane 144 which may be parallel and adjacent to the first plane 143. Generally, the second plane 144 is disposed closer (than the first plane 143) to the bottom portion 101 of the fire pit device 100.

While in use, the lid panel 180 may be received via the channel 142 and ultimately connect with the channel 142. For instance when the fire bowl 150 is not included in the fire pit device 100, the lid panel 180 may ultimately connect to the table top lip (not shown) or the supporting frame 110. In general, the lid panel 180 is substantially flat and defines a first lid surface 181 (FIG. 3A) and a second lid surface 182 (FIG. 1), disposed on one to another. The lid panel 180 generally is configured with a shape substantially similar to the shape of opening 141 for fitting purposes. It is understood that the shape of the lid panel 180 may vary, for example, in selected embodiments the lid panel 180 may be shaped as a circular, rectangular (as seen in the exemplary embodiment in FIG. 1), triangular, a combination thereof, or other suitable longitudinal shapes. In selected embodiments, it may be desired to have lid panel 180 configured to include a channel 118 which may be generally disposed following a lid contour 81 defined by the shape of lid 180. Alternatively, in other embodiments, it may be desired to have the lid panel 180 configured as mesh including a plurality of openings thereof.

With reference to FIG. 3, in various embodiments the fire pit device 100 may further include a door 190 including a panel 112*c* and a frame 191 which may be operably connected to the support frame 110. In embodiments, the door 190 may be configured to swing away and towards the support frame 110 with respect to a selected pivoting axis. For example, the frame 191 may be operably connected to the table top 140 and beam 113 while defining a pivoting axis 193. The door 190 may pivot relative to the pivoting axis 193 while following path 192. Alternatively, the door 190 may be hinged to a leg selected from legs 111-111*c*, in such example the pivoting axis 193 may be defined by the selected leg. It is understood in the selected embodiments, the door 190 may be hinged to the support frame 110. As shown in FIG. 3, the door frame 191 generally is configured as a substantially rectangular frame onto where the panel 112*c* may connect to. Alternatively, the panel 112*c* and the door frame 191 may be configured as one single element during manufacturing.

With reference to FIGS. 3 and 3A, the fire pit device 100 may include at least one stopper 200 which may be connected to the frame 191 or other suitable location along the door frame 190. The door frame 190 defines four corners 194, 194*a*, 194*b*, and 194*c*, and two opposed surfaces (an interior door frame surface 195 and an exterior door frame surface (not shown)). In embodiments, the stopper 200 may be disposed adjacent to a corner selected from corners 194-194*c*. As seen in FIGS. 3 and 3A, the stopper 200 may be disposed near corner 194*c* and it may define a first pocket 201. For example, the first pocket 201 is defined between the stopper 200 and the panel 112*d* and is configured to receive at least a portion of the lid panel 180. While in use, a portion of the lid panel 180 may be fitted into the first pocket 201 and during pivoting of the door 190, the panel 112*d* may pivot along with the door 190. It is understood that the above-noted stopper 200 may be operably coupled to the door frame 191 via hardware elements which implement the described functionality such as screws, pins, or bonding elements (such as glue, weld, etc.) or the like. Alternatively, the door frame 191 may further include at least one door lip 197 which can be configured to connect to the lid panel 180 and ultimately serve as a support thereof. As shown in the exemplary embodiment of FIG. 3, the door lip 197 may be disposed at the bottom portion 198 of door 190 and may be configured as an elongated element which may have a similar horizontal length "L" to the horizontal length "D" of the door frame 191. In embodiments, the door lip 197 includes a substantially L cross-sectional shape. Further, the door lip 197 defines a second pocket 199 which may be configured to receive the lid panel 180. While in use, at least a portion of the lid panel 180 may vertically slide into the first pocket 201, to some extent, following an upward direction towards the edge 194*c* before being received by the second pocket 199. Ultimately, the user may slide the lid panel 180 into the second pocket 199 as seen in FIGS. 3 and 3A. Alternatively, in selected embodiments, the door lip 197 may be configured as a tab or plurality of tabs connected to the interior door frame surface 195 or any other suitable shape which may implement the above-described functionality. In embodiments, door 190 may further include a doorknob 196.

It is also contemplated that lid panel 180 may be configured to be stored in or on any interior or exterior panel or side walls of fire pit device 100.

Turning now to FIGS. 4-10A, an alternative embodiment for the fire pit device 100 and associated with the present disclosure is generally labeled 100*a*. Fire pit device 100*a* includes a support frame 110*a*, a vessel holding structure 130*a*, a tabletop 140*a*, a fire bowl 150*a*, a burner 160*a*, a lid panel 180*a*, and a control box or fluid distribution system 170*a*. In selected embodiments, fire pit device 100*a* may further include a heater 300. In the illustrated embodiments, fire pit device 100*a* is shown having a substantially rectangular shape, however, it is understood that fire pit 100*a* can be configured having other suitable shapes such as circular, triangular, or the like.

Figure 5:
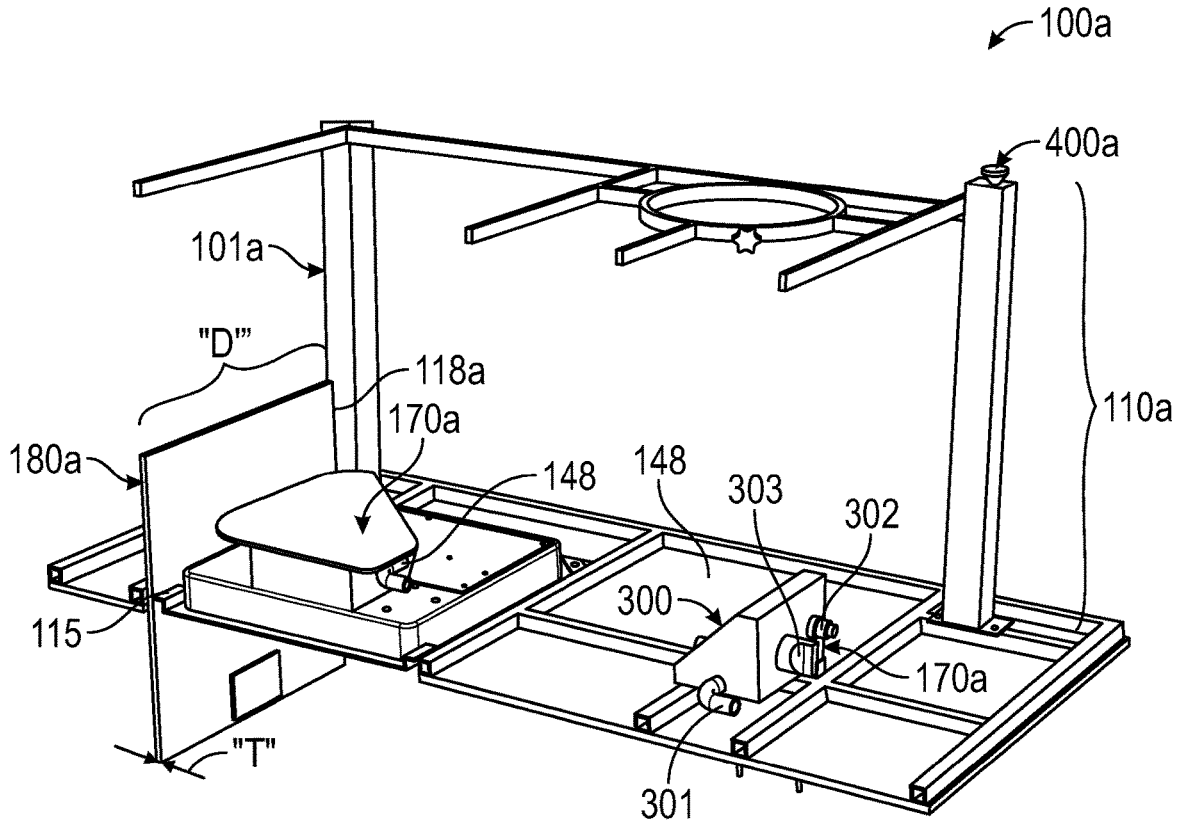
FIG. 5 depicts a bottom view of the fire pit device of FIG. 4 in accordance with the line "5-5" in FIG. 4.
Figure 6:
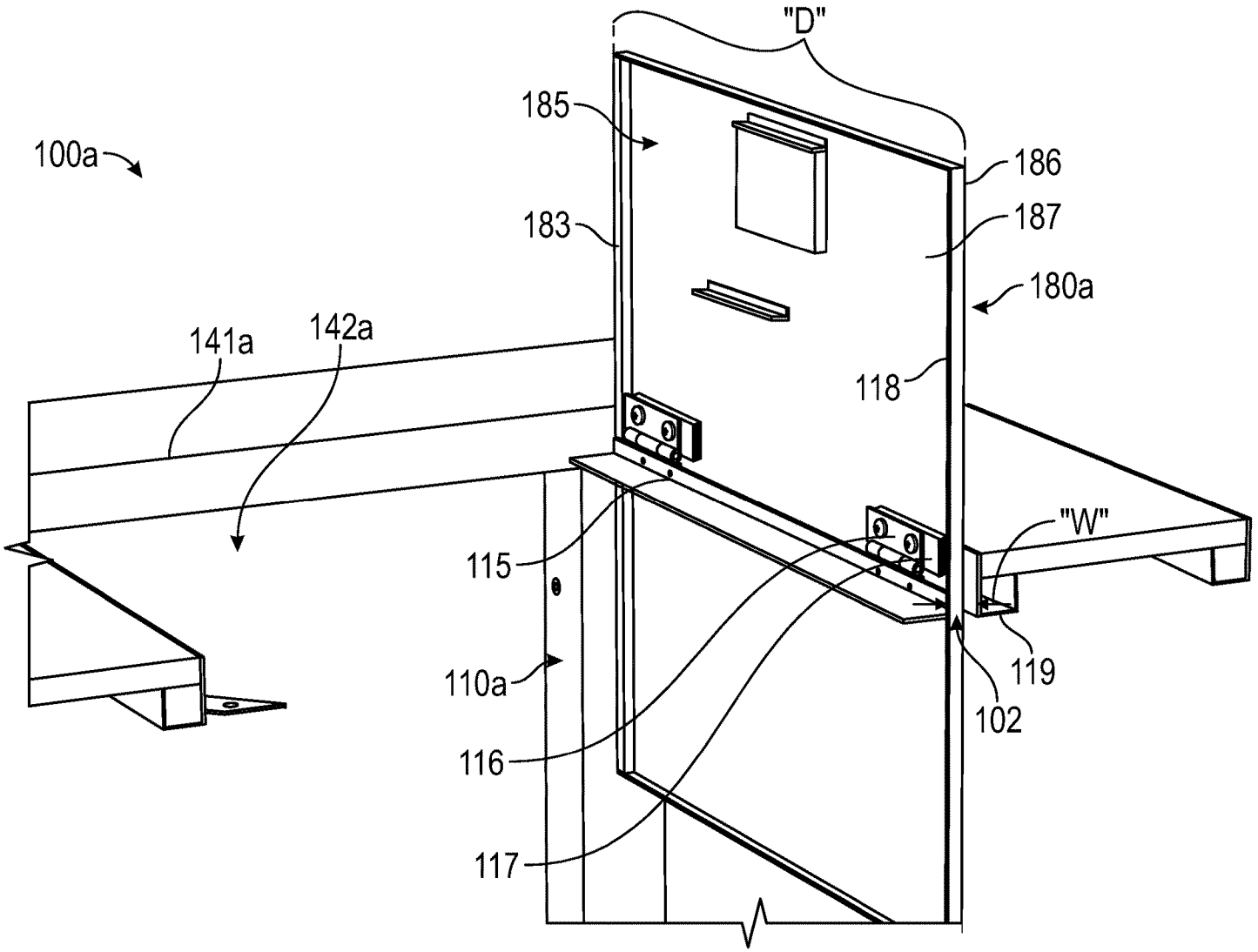
FIG. 6 depicts a cutaway perspective view of a portion of an exemplary embodiment of the fire pit device of FIG. 4, in accordance with the present disclosure.

With reference to FIGS. 5 and 6, as mentioned above the fire pit device 100*a* includes a lid panel 180*a*. The lid panel 180*a* may be configured as a slidable panel operably connected to the support frame 110*a*. For example, the support frame 110*a* may include a panel support beam 115 which may be coupled to at least one hinge 116. The hinge 116 may be further coupled to a pin or retaining tab 117 which may be configured to be received by at least one channel 118*a*. Channel 118*a* may be defined as a U-channel or C-channel configured to function as a guiding track for the retaining tab 117. In embodiments channel 118*a* can be disposed following a lid contour 81*a* which is generally defined by the shape of lid 180*a*. Generally, the channel 118*a* can be defined as an elongated passageway which may be defined in the lid panel 180*a* between the lip panel 183 and one of the surfaces of the lid panel 180. Precisely, the lid panel 180*a* includes a substrate 185 which defines opposed surfaces generally labeled top surface 186 and bottom surface 187. The lip panel 183 may have a substantially L cross-sectional shape and can be coupled to the bottom surface 187 via known in the art elements and methods such as welding, bonding via adhesives, fasteners via screws, or other suitable elements or methods. Alternatively, the lip panel 183 and the substrate 185 may be manufactured as one element.

Further, in FIG. 6 the fire pit device 100*a* includes an opening 102 which may be configured to receive the lid panel 180*a* therethrough. For example, a portion of the support frame 110*a* and the panel support beam 115 define the opening 102. It may be desired to have the opening 102 configured as a substantially elongated gap formed between the panel support beam 115 and a beam 119 the support frame 110*a*. In embodiments, the shape of the opening 102 may be substantially rectangular and may be sized slightly larger (e.g. about 10%) than a lid panel such as the lid panel 180*a*. Moreover, the opening 102 may define an opening length "G" and the opening wide "W" which may be larger than a lid length "D" and a lid thickness "T" defined by lid panel 180*a*. In embodiments the lid made be made out of a sheet metal with having a selected initial thickness and may further have folded edges. Thus, in embodiments "T" may have a value double or more of the selected initial thickness.

Figure 7:
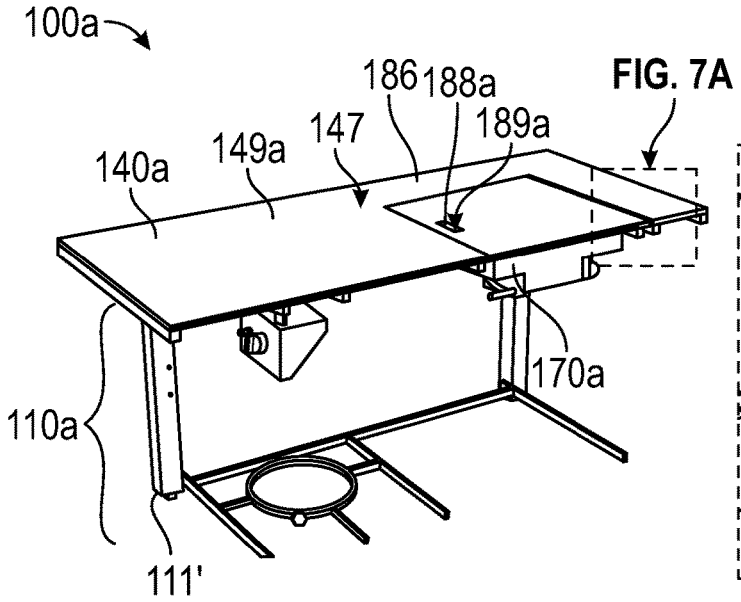
FIG. 7 depicts a top perspective view of the fire pit device of FIG. 5 with a lid covering a fire bowl, in accordance with the present disclosure.
Figure 7A:
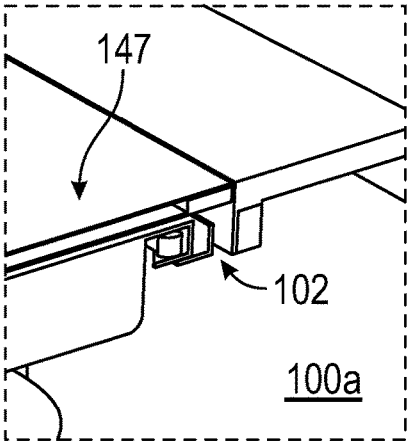
FIG. 7A depicts an enlarged view of the fire pit device of FIG. 7 and in accordance to the section 7A in FIG. 7.

With respect to FIGS. 5-10. The fire pit device 100*a* includes a tabletop 140*a* which may be coupled to the support frame 110*a* via fasteners such as screws, pins, or the like, or via fastening methods such as bolding, welding, or the like. The table top 140*a* defines a tabletop surface 149*a* and a table bottom surface 148. Further, the table top 140*a* may include an opening 141*a* which defines a table channel 142*a* which may be configured to receive the fire bowl 150*a* and the lid panel 180*a*. As seen in FIGS. 7 and 7*a*, the table top surface 149*a* and the top surface 186 may be configured to align substantially parallel to one another, and further define a substantially flat surface 147.

Figure 8:
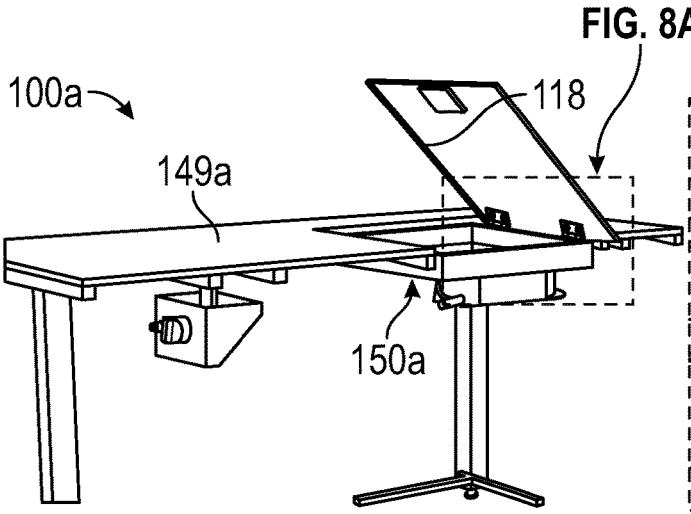
FIG. 8 depicts a top perspective view of the fire pit device of FIG. 7 during operation of the lid, in accordance with the present disclosure.
Figure 8A:
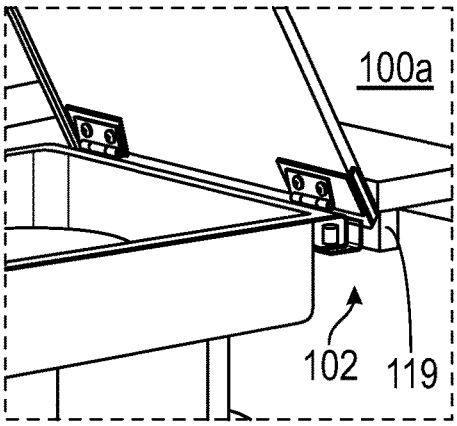
FIG. 8A depicts an enlarged view of the fire pit device of FIG. 8 and in accordance to the section 8A in FIG. 8.
Figure 9:
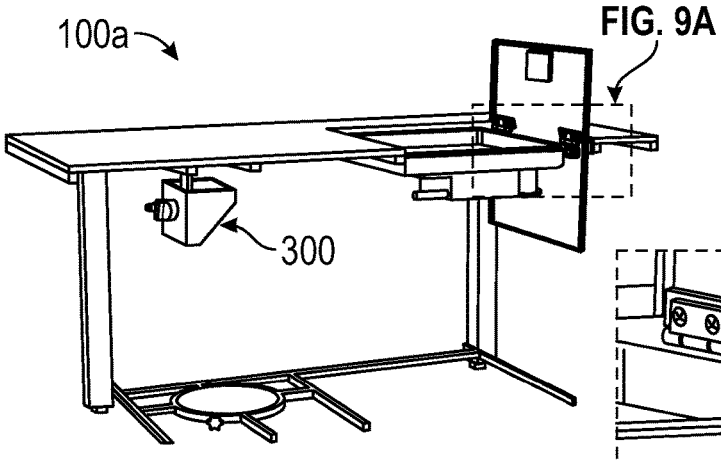
FIG. 9 depicts an enlarged view of the fire pit device of FIG. 8 during operation of the lid, in accordance with the present disclosure.
Figure 9A:
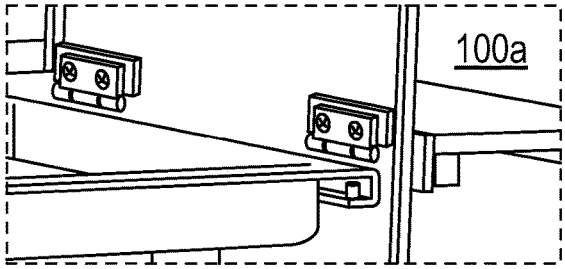
FIG. 9A depicts an enlarged view of the fire pit device of FIG. 9 and in accordance to the section 9A in FIG. 9.
Figure 10:
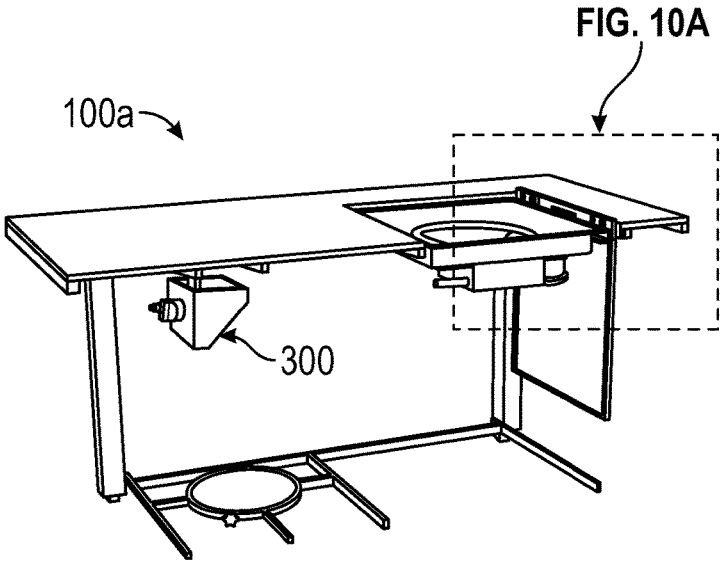
FIG. 10 depicts an enlarged view of the fire pit device of FIG. 9 with the lid not coving the fire bowl, in accordance with the present disclosure.
Figure 10A:
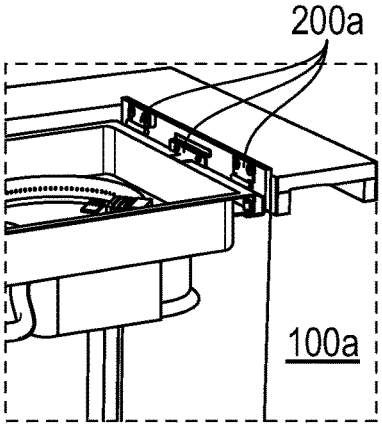
FIG. 10A depicts an enlarged view of the fire pit device of FIG. 10 and in accordance to the section 10A in FIG. 10.

While in use, a user may use the fire pit device 100*a* as a table with a flat top with one or more legs 111', providing a substantially flat surface 147 on which objects may be placed, and that can be used for purposes such as eating, writing, working, or playing games (FIG. 7). Alternatively, the user may use the fire pit device 100*a* as a fire pit in which a contained outdoor fire can be made. (FIGS. 7-10). The user may convert the fire pit device 100*a* from a table to a fire pit by initially lifting a portion of the lid panel 180*a* away from the table top 140*a* (FIGS. 6 and 7) until reaching a substantially perpendicular position with respect to the tabletop surface 149*a* (FIGS. 7 and 8), and ultimately the user may slide the lid panel 180*a* (FIGS. 4-6) through the opening 102 (FIGS. 7A & 8*a*). In embodiments, the lid panel 180 (FIG. 3), or the support frame 110*a* may further include at least one stopper (not shown) connected thereof to prevent the lid panel 180*a* (FIGS. 4-6) from completely passing through the opening 102. For example, as seen in FIGS. 10 and 10*a*, stoppers 200*a* are connected to the lid panel 180*a*. The stopper 200*a* may be connected via fasteners, weld, glue, or other suitable elements or methods. In embodiments, at least one stopper 200*a* may be configured to prevent retaining tab 117 (FIG. 6) from leaving the channel 118*a*, thus, at least one stopper 200*a* may be disposed along channel 118*a*.

As mentioned above the fire pit device 100*a* may further include a heater, likewise, in selected embodiments of the fire pit device 100, the fire pit device 100 may further include a heater or another suitable heating element. For example, as seen in FIGS. 5-10, fire pit device 100*a* includes the heater 300 connected to a portion of the support frame 110*a*. Generally, the heater 300 includes a fluid inlet 301, a starter 302, and a control knob 303 which may be configured to regulate the intensity of the heat generated via the heater 300. In embodiments, the starter 302 may be an electrical starter which may be connected to the control knob 303 in such a way that the starter 302 may be activated when the control knob 303 is pressed. In other words, control knob 303 may control ignition of the heater 300 and regulation of heat intensity thereof. It is understood that in embodiments a flammable fluid container such as a propane gas tank may be operably connected in series or parallel with the heater 300 and a burner 160*a*.

Figure 4:
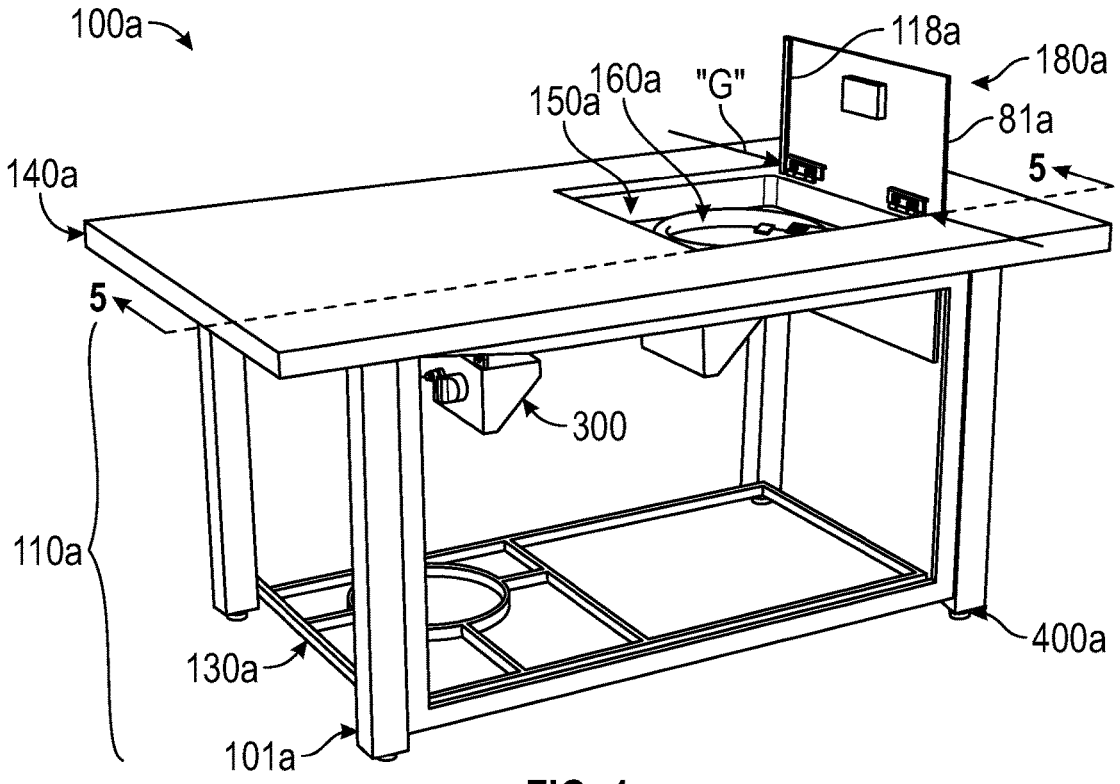
FIG. 4 depicts a top perspective view of an exemplary embodiment of a fire pit device, in accordance with the present disclosure.
Figure 11:
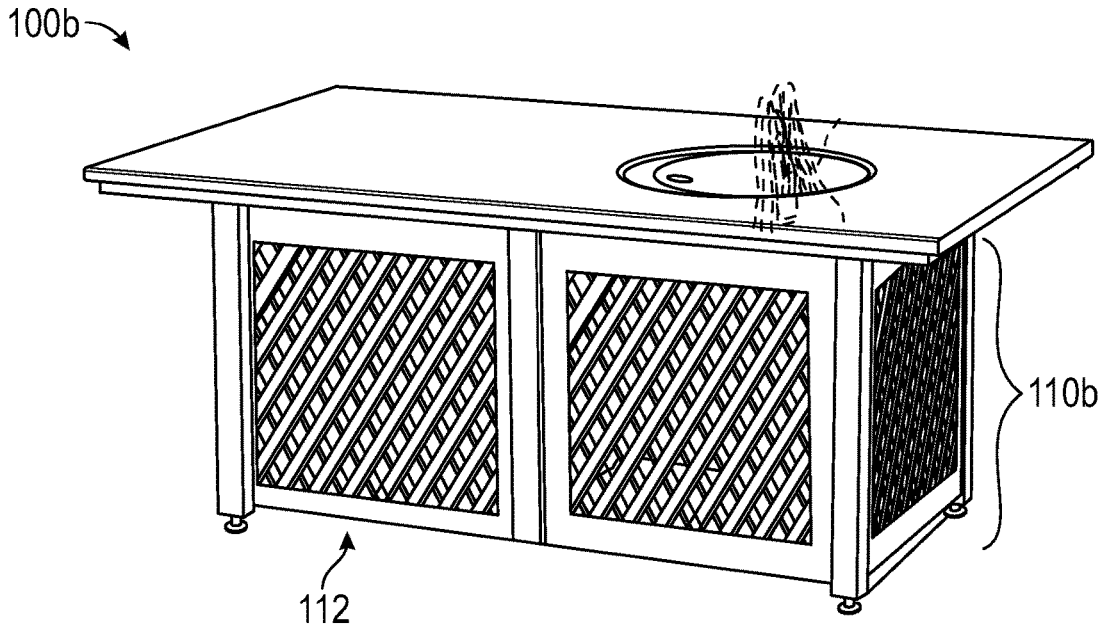
FIGS. 11 and 12 depict perspective views of alternative embodiments of the fire pit device of FIG. 4, in accordance with the present disclosure.
Figure 12:
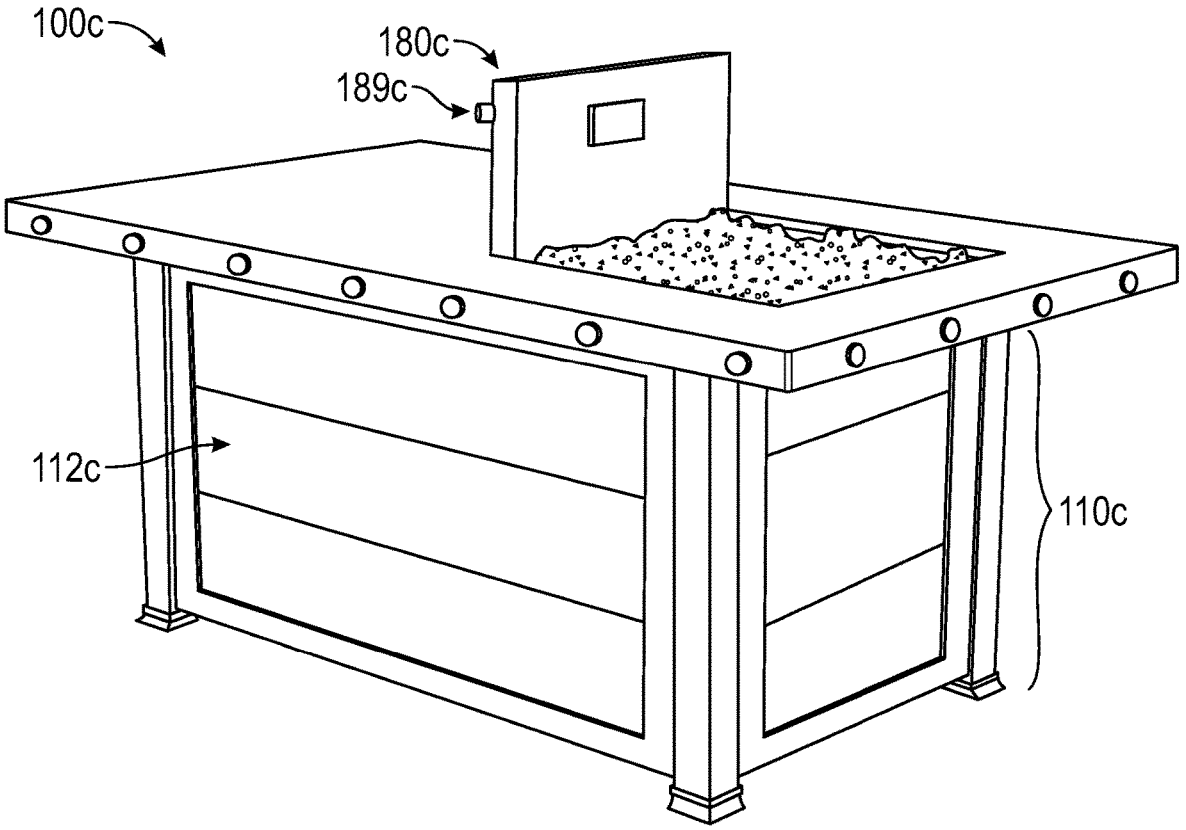

Turning now to FIGS. 11 and 12, alternative embodiments associated with fire pit device 100 generally labeled 100*c*, and 100*b* are presented. Fire pit device 100*c* and 100*b* respectively include at least one panel 112*c* and 112*d* connected to supporting frames 110*c* and 110*d*. In various embodiments, the fire pit devices 100-100*c* may further include a respective non-slip component. For example, as seen in FIGS. 1-3 fire pit device 100 includes at least one non-slip component 400. In another example, as seen in FIGS. 5-10 fire pit device 100*a* includes at least one non-slip component 400*a*. While in use, when the fire pit device 100*a* is placed onto a surface, non-slip components 400*a* may reduce sliding of the supporting frame 110*a* or may reduce the probability of damaging the surface in contact thereof. The non-slip components 400*a* can be disposed near a bottom portion 101*a* and further provide stability to the fire pit device 100*a*. For example, the non-slip components 400*a* may be operably coupled to a plurality of legs 111' as seen in FIG. 4.

With reference to FIGS. 10-12, the fire pit devices 100-100*c* may further include a respective handle. For example, as seen in FIG. 1 the lid panel 180 of the fire pit device 100 may further include a handle 189 having a substantially circular shape and including a movable tab 188. In another example, as seen in FIG. 7 the lid panel 180*a* of the fire pit device 100*a* may further include a handle 189*a* having a substantially C like longitudinal shape and defining a pocket 188*a* configured to receive a portion of a user's hand. In a selected example, as seen in FIG. 12 the lid panel 180*c* of the fire pit device 100*c* may further include a handle 189*c* which may be configured as a pull tab for grasping.

Figure 13:
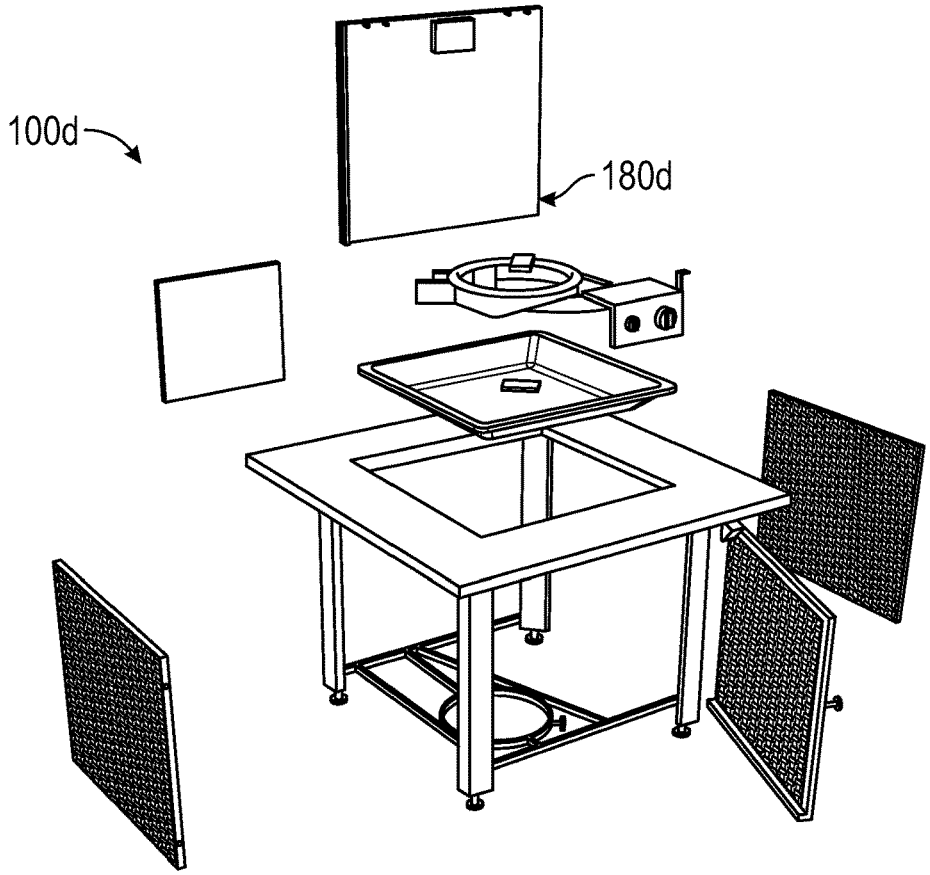
FIG. 13 depicts an exploded front perspective view of an alternative embodiment of the fire pit device of FIG. 1, in accordance with the present disclosure.
Figure 14:
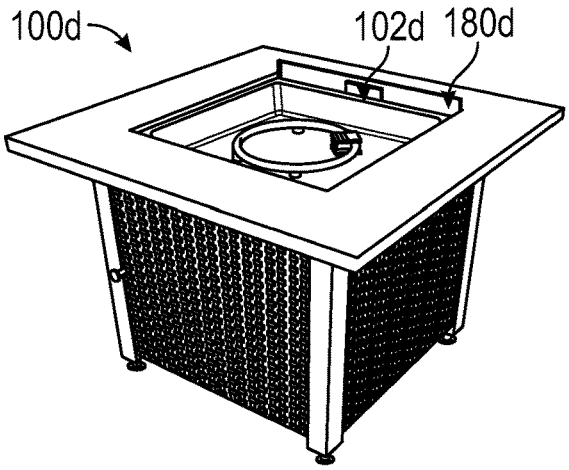
FIG. 14 depicts an assembled front perspective view of the fire pit device of FIG. 13, in accordance with the present disclosure.
Figure 15:
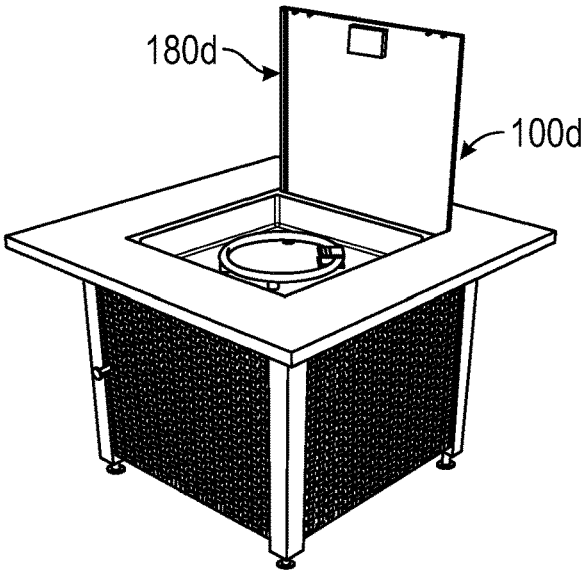
FIG. 15 depicts a front perspective view during operation of the fire pit device of FIG. 14, in accordance with the present disclosure.
Figure 16:
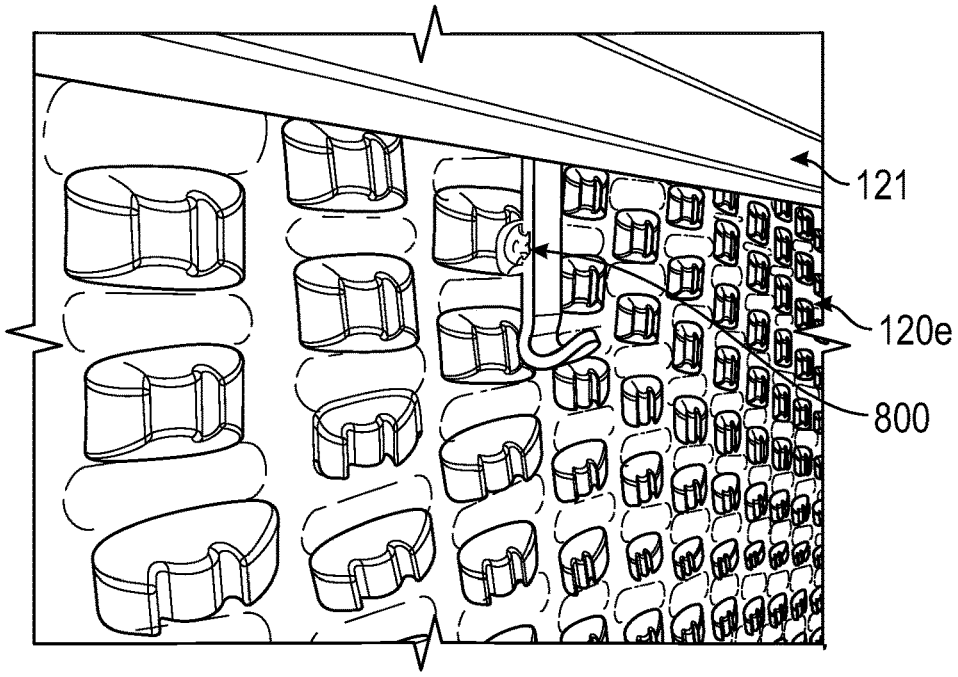
FIGS. 16 and 17 depict enlarged perspective views of portions of a door panel associated with the fire pit device of FIG. 1, in accordance with the present disclosure.
Figure 17:
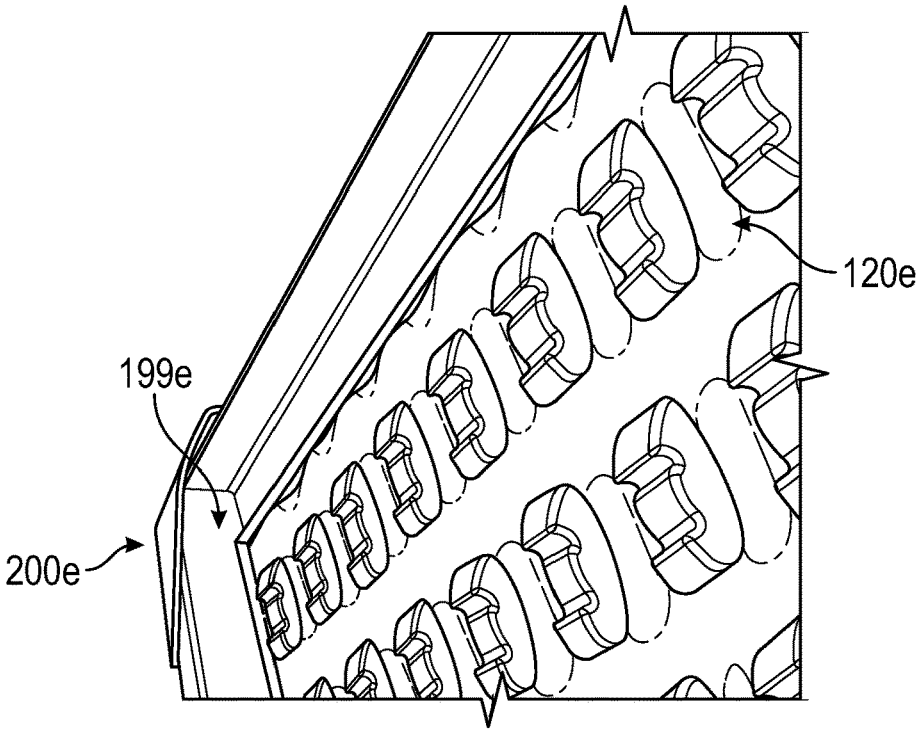
Figure 18:
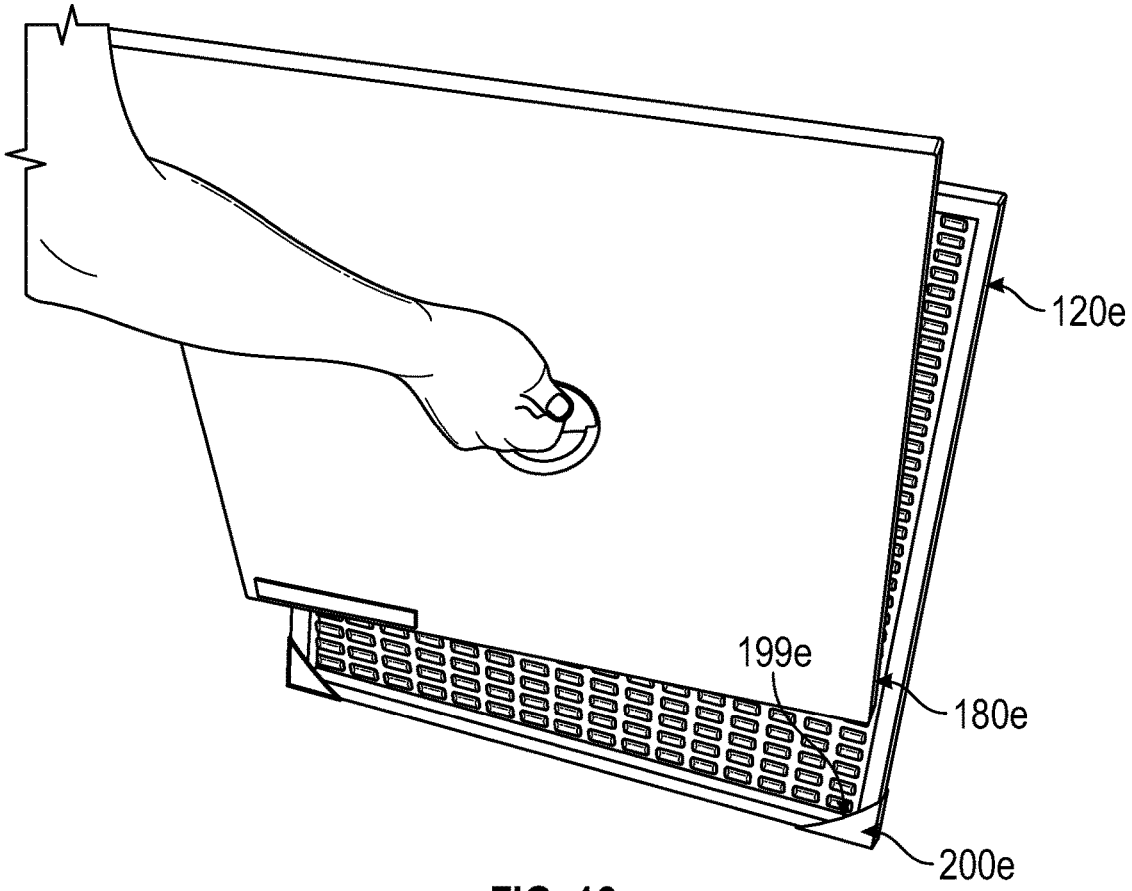
FIG. 18 depicts a perspective view during operation of a lid associated with the fire pit device of FIG. 1 and the door panel of FIGS. 16 and 17, in accordance with the present disclosure.

Now turning to FIGS. 13-15, an alternative embodiment for the fire pit device 100 associated with the present disclosure is generally labeled 100*d*. Fire pit device 100*d* is substantially similar to fire pit device 100 with the exception on how the lid is stored. A lid panel 180*d* is presented in the fire pit device 100*d*. Lid 180*a* may be configured to be hidden or stored in a similar way as any lip panel noted above and further mentioned below. Moreover, while operably connected to the fire pit 100*d*, lid 180*d* can be configured to slide through an opening 102*d*. The configuration of lid panel 180*d* is substantially similar to lid 180*a*, thus, it is understood that elements which are necessary to achieve such a configuration may be included in/for fire pit 100*d*. As such, further description of these elements will be limited to the above mentioned description with respect to fire pit device 100*a* and lid panel 180*a*.

Figure 19A:
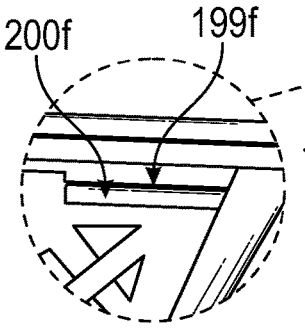
FIGS. 19A and 19B depict cutaway perspective views of a door panel associated with the fire pit device of FIG. 19, in accordance with the present disclosure.
Figure 19:
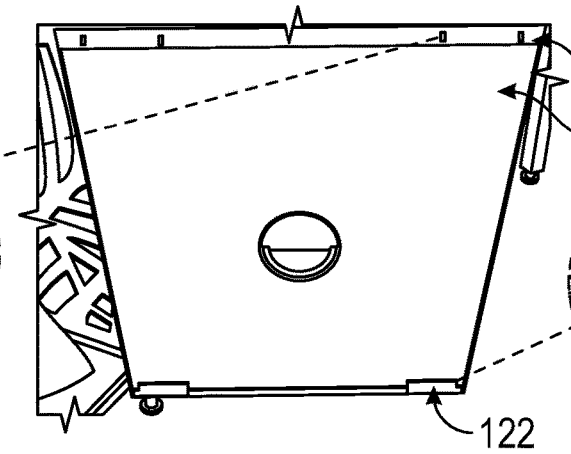
FIG. 19 depicts a perspective view during connection of a lid associated with the fire pit device of FIG. 1 to an alternative embodiment of the fire pit device of FIG. 1, in accordance with the present disclosure.
Figure 19B:
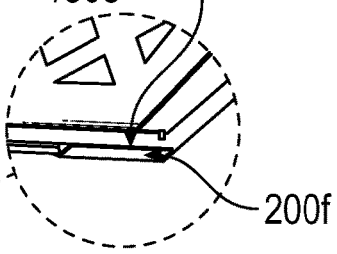
Figure 20:
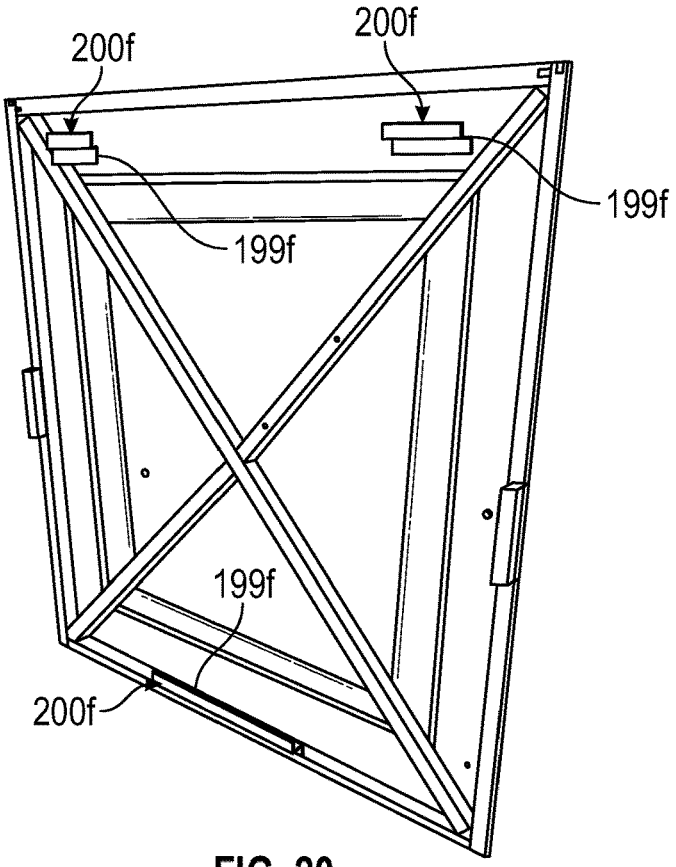
FIGS. 20 and 21 depict perspective views of alternative embodiments of a door of the fire pit device of FIG. 1.
Figure 21:
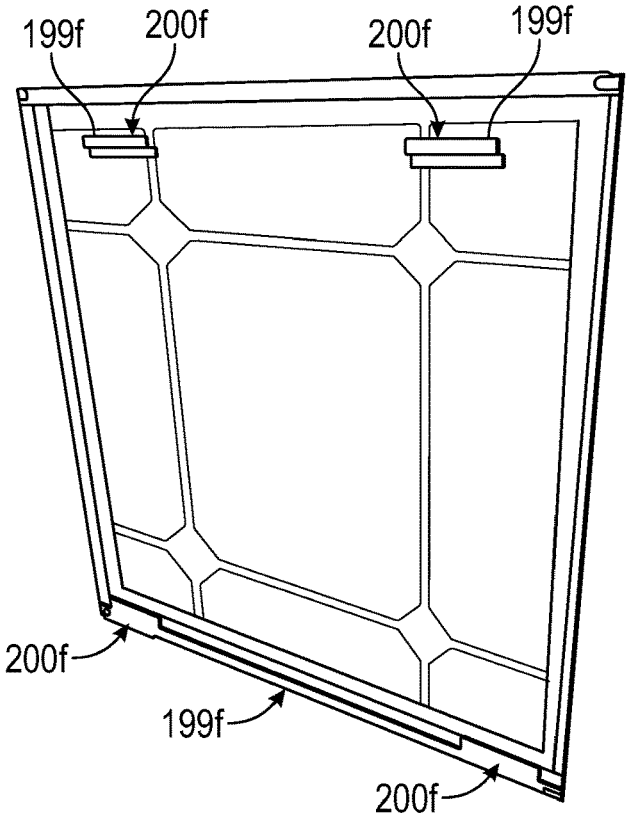

With respect to FIGS. 16-22, alternative embodiments of door panel 120 and lid panel 180 (which may be used with the fire pit device 100, or any other of the above mentioned fire pits is depicted) is generally labeled door panel 120*e* and lid panel 180*e*. The door panel 120*e* may include at least one stopper 200*e* (FIG. 18) or 200*f* (FIGS. 19-21), and the stopper(s) may further define at least one corresponding pocket 199*e* and 199*f* (FIGS. 19-21). The pocket(s) (199*e* and 199*f*) can be configured to receive a lid panel such as lid panel 180*e* or any other of the above mentioned lid panels. In some embodiments, such as the exemplary embodiment in FIG. 16, a hook 800 may be located and connected to a top portion 121 of the door panel 120*e*. The hook 800 can be configured to receive the lid panel 180*e*, or alternatively a stopper 200*f* may be used instead as seen in FIG. 19. In embodiments, it may be desired to have two stoppers 200*f* connected to the door panel 120*e*, a first stopper connected to the top portion 121 and a second stopper connect to the a bottom portion 122 of the door panel 120*e*. In another embodiment, it may be desired to have a stopper 200*e* connect to the bottom portion 122 and a stopper 200*f* connected to the bottom portion 121.

Figure 22:
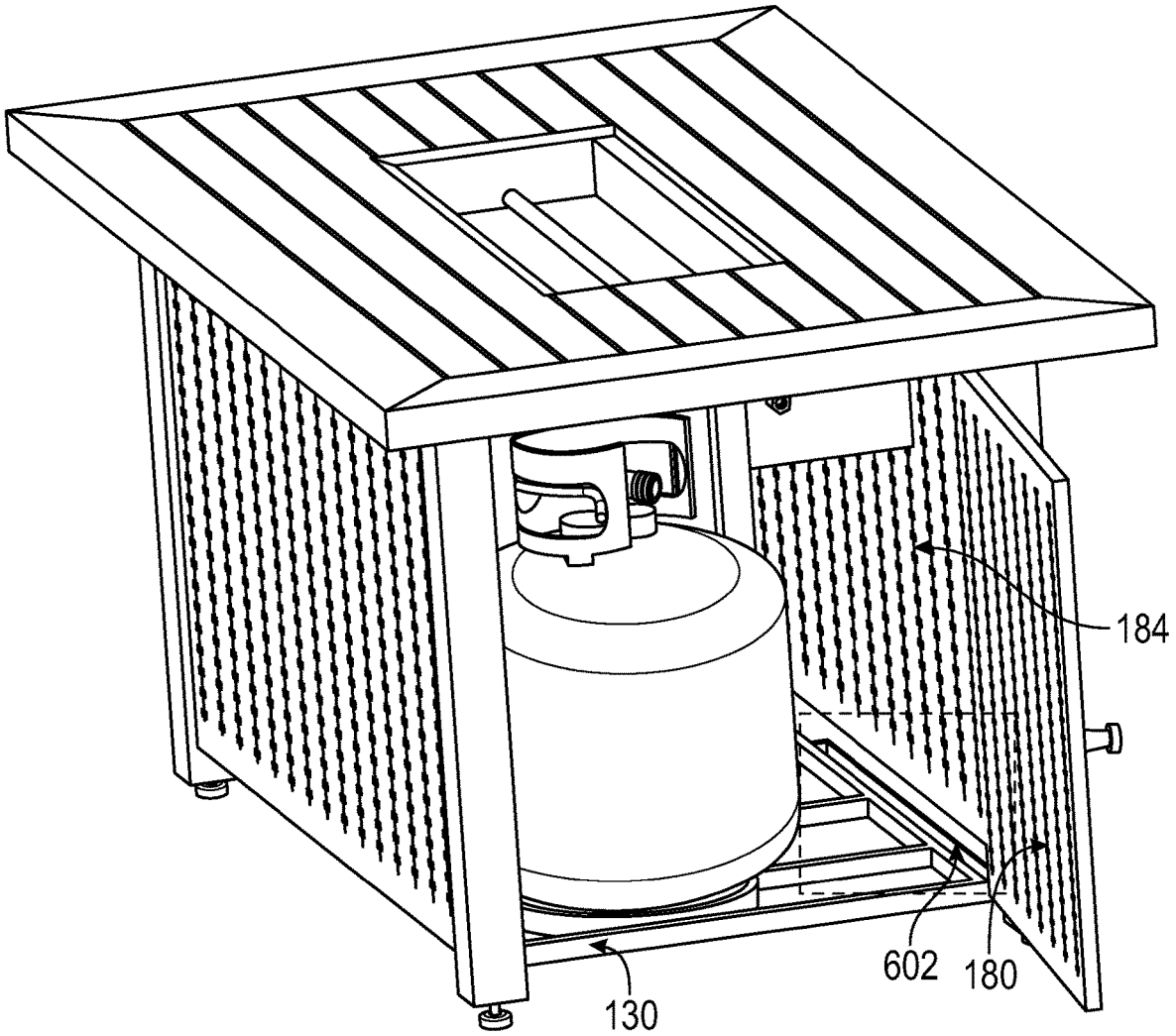
FIG. 22 depicts a perspective view of an alternative embodiment of the fire pit device of FIG. 1.

Further, in selected embodiments the fire pit device 100 (or any of the above noted alternative embodiments) may further include a lip 300*f* defining a pocket 300*e* (FIG. 21). The lip 300*f* is connected to a door panel such as door panel 120 or 120*e* defining the pocket 300*e* therebetween and is configured to receive a lid panel such as lid panel 180. Turning now to FIG. 22, the fire pit device 100 may further include an opening 602. The opening 602 is a slot connected to the support frame 110 configured to receive the door panel 180; alternatively the opening 602 may be formed between the vessel support structure 130 and board 184.

Figure 23:
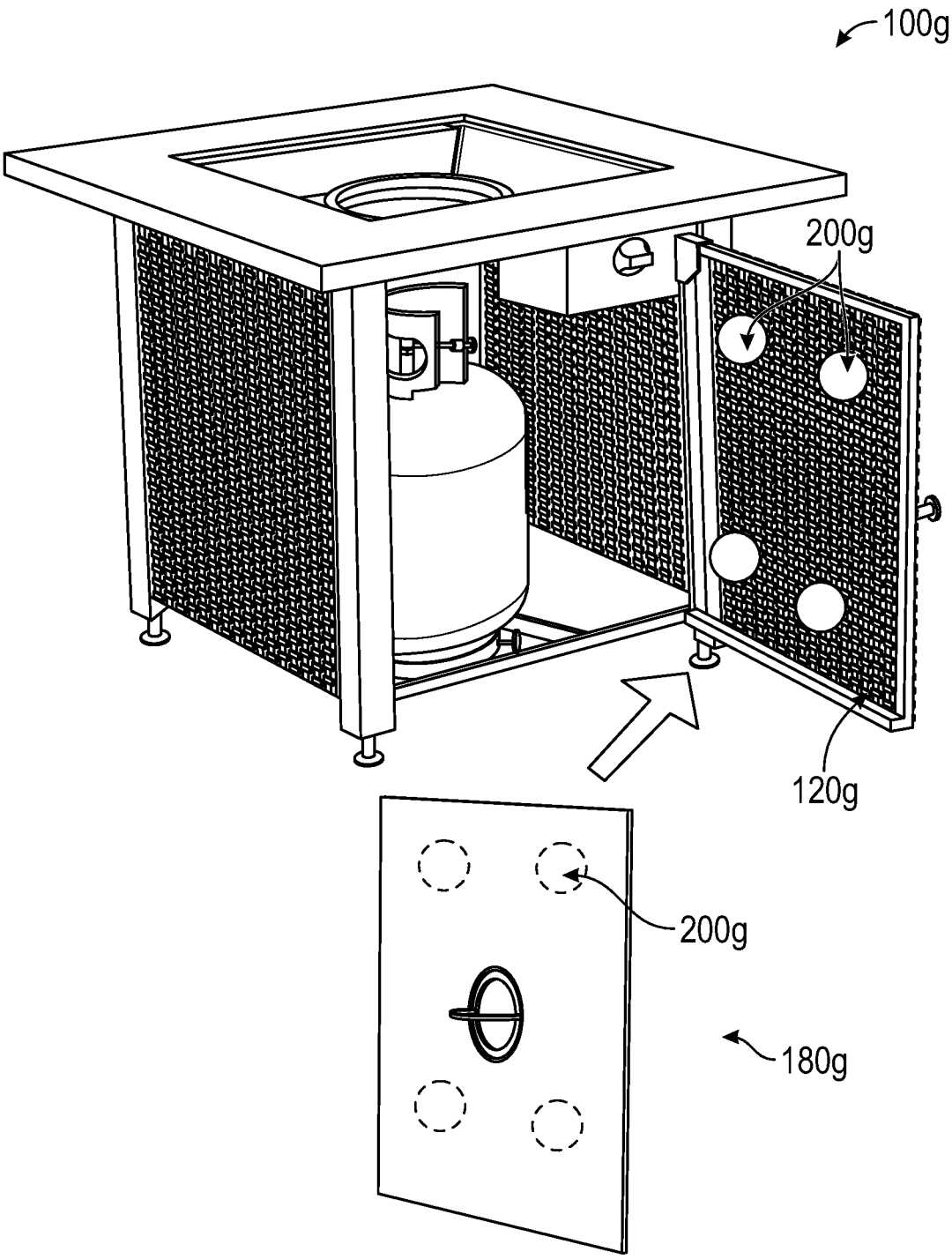
FIG. 23 depicts a perspective view of an alternative embodiment of the fire pit device of FIG. 1.

Turning now to FIG. 23, an alternative embodiment for the fire pit device 100 is presented as fire pit device 100*g*. Fire pit device 100*g* may be substantially similar to the fire pit device 100, with a slight variation to the door panel, such as door panel 120, while including at least one magnetic connector such as magnetic 200*g*. The magnetic connector 200*g* includes a disk-like shape, however, the magnetic connector 200*g* may include other suitable shapes, e.g., square, oval, triangular, rectangular, or any suitable shape. The magnetic connector 200*g* may be removably coupled or may be fixed to a door panel such as door panel 120*g* (or other door panels disclosed herein, e.g., door panel 120) and/or to a lid panel such as lid panel 180*g* (or other lid panels disclosed herein, e.g., door panel 180). The magnetic connector 200*g* emits a magnetic field which is invisible to the eye but is responsible for the most notable property of magnets, which is generation of a force that pulls on other ferromagnetic materials, such as iron, and attracts or repels other magnets. Thus, while in use, when the magnetic connectors 200*g* are connected to door panel 120*g* and lid panel 180*g* the magnetic connectors 200*g* may enable connection between the two panels (120*g* and 180*g*). Alternatively, a portion of the pit device 100*g* can be manufactured (or may include an element) with a material that enables a magnetic bond or attracts the magnetic connectors 200*g* (e.g. iron), for example, the door panel 120*g* may be an iron door while the magnetic connector 200*g* can be connected to the lid panel 180*g*. Moreover, lid panel 180*g* may be configured to be stored via the magnetic connectors 200*g* on any portion of the interior or exterior of the fire pit device 100*g* so that the lid panel is not easily lost or misplaced and so that the area around the fire pit device is kept neat.

The embodiments disclosed herein are examples of the disclosure and may be embodied in various forms. For instance, although certain embodiments herein are described as separate embodiments, each of the embodiments herein may be combined with one or more of the other embodiments herein. Structural and functional details disclosed herein are not to be interpreted as limiting, but as a basis for the claims and as a representative basis for teaching one skilled in the art to variously employ the present disclosure in virtually any appropriately detailed structure. Like reference numerals may refer to similar or identical elements throughout the description of the figures.

The phrases "in an embodiment," "in embodiments," "in various embodiments," "in some embodiments," or "in other embodiments" may each refer to one or more of the same or different embodiments in accordance with the present disclosure. A phrase in the form "A or B" means "(A), (B), or (A and B)." A phrase in the form "at least one of A, B, or C" means "(A); (B); (C); (A and B); (A and C); (B and C); or (A, B, and C)."

It should be understood that the foregoing description is only illustrative of the present disclosure. Various alternatives and modifications can be devised by those skilled in the art without departing from the disclosure. Accordingly, the present disclosure is intended to embrace all such alternatives, modifications, and variances. The embodiments described with reference to the attached drawing figures are presented only to demonstrate certain examples of the disclosure. Other elements, steps, methods, and techniques that are insubstantially different from those described above and/or in the appended claims are also intended to be within the scope of the disclosure.

What is claimed is:

1. A storable panel system, comprising:

a table top configured to receive a lid panel configured to connect to the table top wherein the lid panel defines a lid contour and includes a first planar lid surface and a second planar lid surface disposed on the first planar lid surface; and a support frame connected to the table top, the support frame including side walls and a door which is selectively operably connected to the support frame, wherein at least one of a side wall or the door of the support frame is configured to receive and store the lid panel on the side wall and/or the door via at least one of the first planar lid surface, the second planar lid surface, or a lip panel following the lid contour, and wherein the door is hinged to the support frame and has at least one pocket adjacent thereof and includes a door lip configured to support the lid panel when the lid panel slides into the pocket and the door lip.

2. The storable panel system according to claim 1, wherein the support frame includes a hook for receiving the lid panel.

3. The storable panel system according to claim 1, wherein the door includes a stopper disposed near a corner of the door, wherein the at least one pocket is formed between the stopper and the door, wherein when the lid panel slides into the at least one pocket and the door lip, the lid panel is supported by the door lip.

4. The storable panel system according to claim 1, further comprising a fire bowl configured to the table top.

5. The storable panel system according to claim 1, further comprising a burner.

6. The storable panel system according to claim 5, further comprising a fuel distribution system connected to the burner.

7. The storable panel system according to claim 6, further comprising a heater connected to the fuel distribution system.

8. The storable panel system of claim 1, wherein the system is a piece of furniture for housing a fire pit.

9. A method of storing a lid panel when not in use as a cover for a table top in the storable panel system of claim 1, the method comprising:

removing the lid panel from the table top; and connecting the lid panel to the portion of the support frame configured for receiving and storing the lid panel.

10. The method according to claim 9, wherein the connecting includes locally storing the lid panel within the support frame of the table.

11. The method according to claim 9, wherein the connecting includes storing the lid panel in the at least one receiving pocket in the support frame.

12. The method according to claim 9, wherein the connecting includes storing the lid panel in the support frame via a hook for receiving the lid panel.

13. The method according to claim 9, wherein the connecting includes storing the lid panel on or in the side walls of the support frame configured to receive and store the lid panel.

14. The storable panel system according to claim 1, wherein the lid panel is stored in or on an interior of the support frame or an exterior of the support frame.

15. A multi-use convertible furniture piece, comprising:

a table top including a removable lid panel on a portion of the table top, wherein the lid panel defines a lid contour and includes a first planar lid surface and a second planar lid surface disposed on the first planar lid surface, a support frame extending from the table top, the support frame including side walls, and a door selectively connected to the support frame and table top, wherein at least one of a side wall or the door of the support frame is configured to receive and store the lid panel in the interior of the support frame or on the exterior of the support frame, wherein the lid panel is received in or on the side wall and/or the door of the support frame via at least one of the first planar lid surface, the second planar lid surface, or a lip panel following the lid contour, wherein the support frame includes a hook for receiving the lid panel, and wherein the support frame includes a lip configured to support the lid panel.

16. The multi-use convertible furniture piece according to claim 15, wherein the door is hinged to the support frame and has at least one pocket adjacent thereof and wherein the lip is configured to support the lid panel when the lid panel slides into the pocket and the lip.

17. The multi-use convertible furniture piece according to claim 15, further comprising a fire bowl in the table top under the lid panel.

18. The multi-use convertible furniture piece according to claim 15, further comprising a burner.

19. The multi-use convertible furniture piece according to claim 18, further comprising a fuel distribution system connected to the burner and a heater connected to the fuel distribution system.

20. The multi-use convertible furniture piece according to claim 15, wherein the furniture piece is an outdoor fire pit.

21. The multi-use convertible furniture piece according to claim 15, wherein the lid panel is received by both the hook and the lip of the support frame.

* * * * *